United States Patent [19]

Terraillon

[11] 4,321,024

[45] Mar. 23, 1982

[54] FORMWORK APPARATUS FOR CASTING DIRECTLY ON THE GROUND ACCURATE CONCRETE SLABS

[76] Inventor: Paul Terraillon, Le Mont Gosse, F-74560 Monnetier-Mornex, France

[21] Appl. No.: 197,868

[22] Filed: Oct. 17, 1980

[30] Foreign Application Priority Data

Oct. 22, 1979 [CH] Switzerland ..... 9460/79

[51] Int. Cl.[3] ..... B28B 21/60; B28B 21/76

[52] U.S. Cl. ..... 425/111; 249/1; 249/2; 249/8; 249/83; 249/117; 249/160; 254/98; 254/100

[58] Field of Search ..... 404/106, 119; 249/1, 249/2, 4, 6, 117, 160, 24, 28, 204, 207, 82; 254/98, 100

[56] References Cited

U.S. PATENT DOCUMENTS

| | | | |
|---|---|---|---|
| 807,511 | 12/1905 | Slonecker | 254/98 |
| 912,062 | 2/1909 | Bendle | 254/100 |
| 1,350,603 | 8/1920 | Gerritsom et al. | 249/85 |
| 1,704,031 | 3/1929 | Boehm | 254/98 |
| 1,739,254 | 12/1929 | Mosel | 249/2 |
| 2,809,414 | 10/1957 | Mitchell | 249/2 |
| 3,072,994 | 1/1963 | Brickman | 249/2 |
| 3,239,188 | 3/1966 | Gostling | 249/24 |
| 3,347,514 | 10/1967 | Yates | 249/2 |

FOREIGN PATENT DOCUMENTS

| | | | |
|---|---|---|---|
| 1907800 | 8/1970 | Fed. Rep. of Germany | 249/207 |
| 911349 | 11/1962 | United Kingdom | 249/2 |
| 1066862 | 4/1967 | United Kingdom . | |

*Primary Examiner*—Willard E. Hoag
*Attorney, Agent, or Firm*—Ladas & Parry

[57] ABSTRACT

Metal supports (1), are provided to rest on the ground and to removably support metal forms (2). These supports are provided with screw (4) and nut (9) means used for accurately adjusting in elevation the forms. Removable struts (16) are used to fix the gap or spacing between parallel forms and tension wires (17) going through the forms are used to secure the forms during the casting of the concrete. Means are provided to stretch and secure (20, 21) these wires with respect to the forms.

This apparatus allows to make a slab of which the upper face is perfectly horizontal and at the level desired, with a minimum of time devoted to the setting in place and removing of the apparatus.

5 Claims, 4 Drawing Figures

FORMWORK APPARATUS FOR CASTING DIRECTLY ON THE GROUND ACCURATE CONCRETE SLABS

When casting concrete slabs directly on the ground, the casting is carried out by successive or adjacent bands by using as formwork wooden forms that are nailed onto a stake driven in the ground. The ground being uneven and the mode or method for fixing the forms to the stakes being rather coarse, it is difficult to obtain perfectly horizontal slabs. Further, the setting in place of formwork elements is relatively lengthy and the equipment used has not a very long life time since the successive driving and removal of nails deteriorates the forms.

The U.S. Pat. Nos. 2,281,946 and 4,066,237 and the Swiss Patent Application No. 255.652 depict such apparatuses intended to be anchored into the ground. In the U.S. Pat. No. 2,014,826, there is disclosed an apparatus which does not require any anchoring and which may be set directly onto the ground, but does not allow to cast accurate concrete slabs, since it is not provided with adjusting means allowing to compensate for the inevitable local inequalities of the ground level, when the ground has not been previously levelled precisely.

The present invention aims at providing a formwork appartus allowing to cast directly on the ground precise concrete slabs, that is to say perfectly horizontal by proceeding by successive bands, without the need for any anchoring into the ground.

This apparatus defers from known systems by the fact that it comprises supports preferably made of metal provided to rest on the ground and to removably support metal forms. These supports are provided with adjusting means for adjusting in elevation the forms. This apparatus further comprises removable struts to fix the gap of two parallel forms used for casting a concrete band, tension wires intended to be stretched between the forms by going through them and means for stretching said wires and making them still with respect to the forms.

The drawing annexed represents as way of example one form of execution of the apparatus object of the invention.

The apparatus represented comprises metal supports 1 which are arranged on the ground after it has been levelled and the alignment fixed by means of strings. The apparatus comprises forms 2 that are set in place according to the alignment of the strings by making them rest, as it will be seen further, on one portion of the supports 1.

Figures 1, 3, 4:
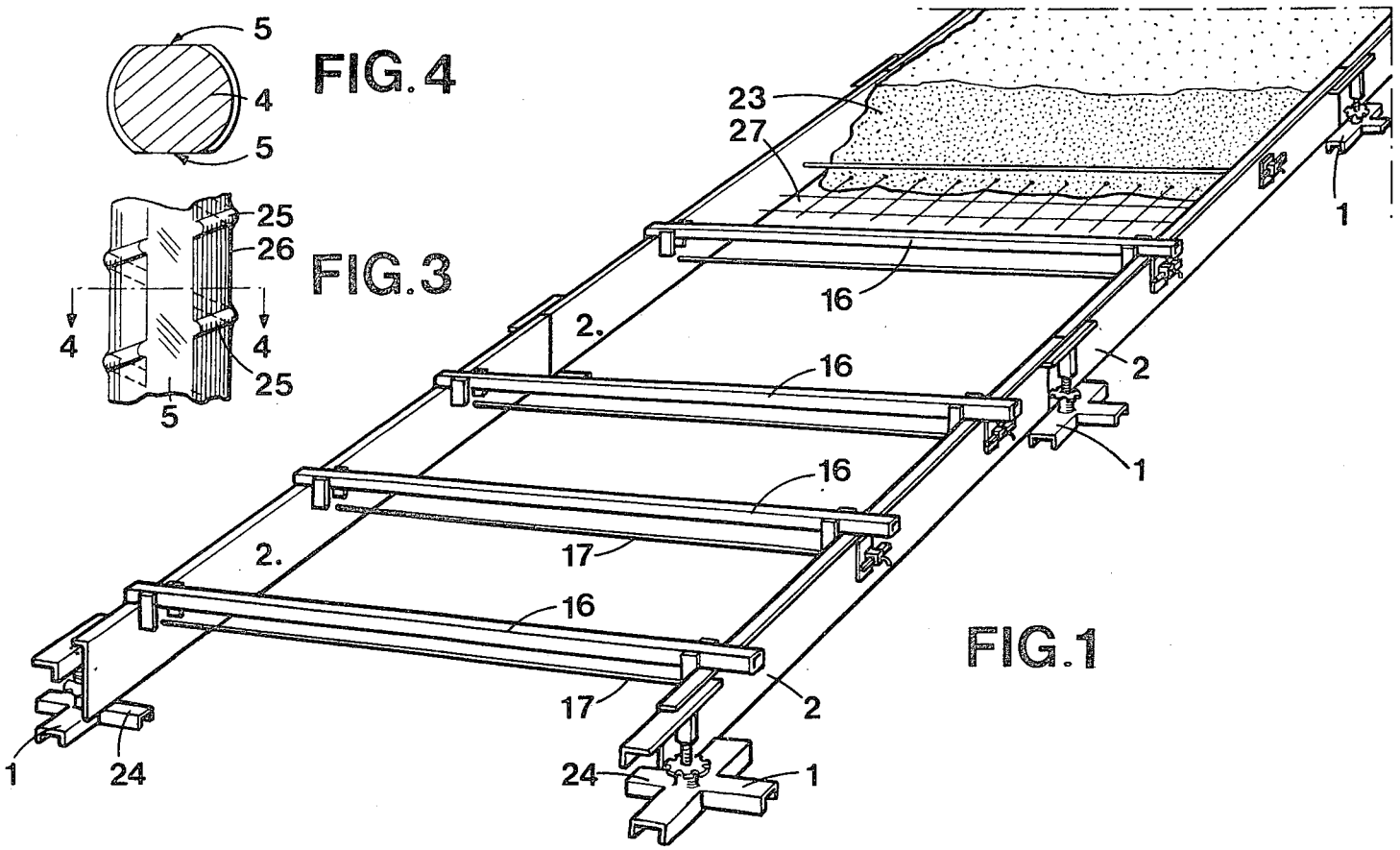
FIG. 1 is a perspective view of the apparatus during a concrete casting operation to form a band which, after juxtaposition with similar bands, will form a slab resting directly on the ground.
FIG. 3 is a detailed view, in elevation, of an apparatus element.
FIG. 4 is a cross-section view according to line 4—4 of FIG. 3.
Figure 2:
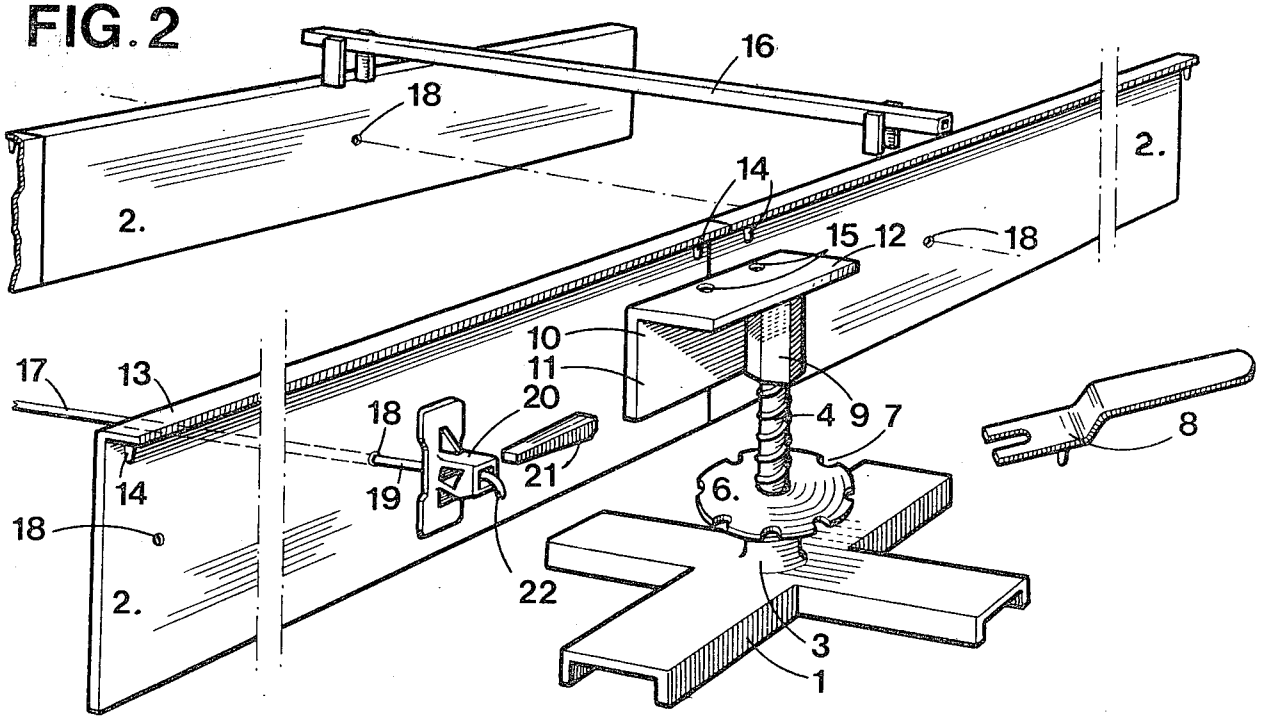
FIG. 2 is also a perspective view but on a higher scale, showing a portion of the apparatus according to FIG. 1.

In reference to FIG. 2, it may be seen that each support 1 is formed by a base comprised of a cross of U-shaped sections. At the middle or centre of this cross there is provided in 3 a bossing wherein is engaged the lower rough part of a screw 4 presenting two flats 5 (FIGS. 3 and 4) so that the screw is maintained vertically, that is to say perpendicularly to the base and it is prevented to rotate about itself. This screw is integral with a disc 6 presenting peripheral notches 7 and which is used to rotate the screw by means of a forked key 8.

On this screw, there is engaged a nut 9 integral with a rest piece 10 having the shape of a corner of which one wing 11 is vertical and the other 12 is horizontal.

The forms 2 have at the lower part thereof a flange 13 perpendicular to the main plane of the form. It is by means of this flange that the forms bear on the part 12 of the rest pieces 10 while the main body of the forms applies against the vertical wing 11 of these rest pieces.

These supports 1 are arranged at the place where two successive forms are in contact and there is provided on the lower face of the flange 13 studs 14 intended to be engaged in corresponding holes 15 in the wing 12, to ensure the correct longitudinal positioning of successive or adjacent forms 2. The correct vertical positioning of the forms is carried out by rotating each of the screws 4 so as to bring the upper edge of the forms along or according to horizontal lines located in the plane of the upper face of the concrete slab that is to be formed. This adjustment may be carried out with all the precision desired for such a work.

When the forms are thus brought onto the pieces 10 of the supports 1, struts 16 are arranged between the two rows of forms, so as to provide for the correct gap or spacing between the forms. To make sure that the forms do not have a tendency to put pressure horizontally on the supports 1, which would displace them and deteriorate the correct alignment of the forms, when the concrete is cast, there are provided tension metal wires 17 which are passed through holes 18 (one only is visible in FIG. 2) provided in the forms. At one of the ends, these wires 17 are bent at right angles and apply against the vertical outer face of one of the forms. The other end, visible in 19 is engaged in a retaining part 20 provided to receive a metal wedge 21. By means of a known type tool an action is effected on the ending portion 22 of the wire 17 to exert a tension on the wire and the wedge 21 is driven in the retaining part 20 so as to wedge in the latter the wires 17 so as to force it to remain under tension. The wires 17 are regularly spaced and the struts 16 are placed just at the vertical of the wires. Thus, the two parallel forms are strongly held in the correct position and are not subject to any substantial displacement or deformation when the concrete is cast, as indicated in 23.

It is to be noted that the supports 1 are placed so that only one of the arms, 24, of the cross-shaped base is engaged under the forms and partially under the edge of the slab when the casting is finished.

The screw 4 has, as seen in FIG. 3, a thread 25 of which the cross-section is substantially semi-circular. The successive turns of the thread 25 are separated by a cylindrical portion 26 relatively bigger with respect to the width of the thread itself. This arrangement allows to readily detach the concrete which could incidentally deposit on the screw during a casting operation and which would have hardened on this screw. Due to the form of the thread and due to the important dimension of the cylindrical portion 26 separating successive turns, it is easy, as experience has proved it, to remove the concrete simply by giving one or two strokes on the screw with a hammer, for example.

When the concrete has been cast between the two parallel forms visible in FIG. 1, the upper surface of the concrete is levelled continuously by means of a plank which is hand held so that this upper face of the concrete band is perfectly horizontal and is even with the upper edge of the forms. Of course, during the casting operation, the struts 16 are removed one after the other as one is getting closer to them. On the other hand, the tension wires 17 remain embedded in the concrete. The presence of the struts is in fact not necessary any more as soon as the concrete has been cast, since the mass of the concrete opposes to a getting closer of the forms under the effect of the tension of the wires 17.

When the concrete has set, the wedges 21 are disengaged from the parts 20 and the parts 20 are removed. The exceeding portion 19 of the wires 17 is cut off and thereafter the forms and the supports 1 may be removed without any difficulty. When the whole assembly has been dismounted, a band of concrete is formed and the same procedure may be repeated a bit further by jumping the width of one band, so as to obtain finally a series of parallel bands of concrete, all of them perfectly level with, between them, empty bands wherein it is just a question of casting concrete, the bands already built forming the formwork.

The apparatus depicted may be used indefinitely and allows to make slabs of any size, by using according to the case, the necessary number of forms and supports to form the successive concrete bands.

The reinforcement 27 of the concrete may be set in place before the tension wires 17 or after, according to the position of the reinforcement in the concrete. The adjustment in elevation of the forms, as it has been said hereabove, may be carried out very accurately by means of a working site telescope or even simply with a water-level. The apparatus disclosed allows to build a slab of which the upper face is perfectly horizontal and at the level desired, with a minimum of time devoted to the setting in place and removing of this apparatus.

I claim:

1. Formwork apparatus for casting directly on the ground accurate concrete slabs, by successive or adjacent bands, characterized in that it comprises supports provided for resting on the ground and for removably supporting metal forms and provided with accurate adjusting means for adjusting in elevation the forms, removable struts for fixing the gap between two parallel forms, tensioning wires intended to be stretched between the forms therethrough, and means for stretching these wires and securing them with respect to the forms, said adjusting means being a jack-screw having a thread of substantially semi-circular section and, between the turns of the thread, a cylindrical root portion, so as to facilitate the removal of the residual concrete remaining on the screw after dismounting the formwork.

2. The apparatus of claim 1 wherein said jackscrew comprises a nut which co-operates with said screw and carries a piece on which the form may rest, means being provided to rotate the screw in order to adjust the height of the form.

3. Apparatus according to claim 1, characterized in that the portion of the supports on which the form bears has the shape of a corner of which one wing is vertical and the other horizontal, the form being intended to be applied on the vertical wing, while a horizontal upper edge of the form bears on the horizontal wing.

4. Apparatus according to claim 3, characterized in that the upper horizontal edge of the forms has studs provided for temporary engagement in corresponding holes provided in said horizontal wing.

5. Formwork apparatus for casting directly on the ground accurate concrete slabs, by successive or adjacent bands, characterized in that it comprises supports provided for resting on the ground and for removably supporting metal forms and provided with accurate adjusting means for adjusting in elevation the forms, removable struts for fixing the gap between two parallel forms, tensioning wires intended to be stretched between the forms therethrough, and means for stretching these wires and securing them with respect to the forms, said adjusting means being a jack screw having a metal base in the shape of a cross, legs of said cross having a u-shaped cross section and opening downward.

* * * * *